US005205684A

United States Patent [19]

Meskin et al.

[11] Patent Number: 5,205,684

[45] Date of Patent: Apr. 27, 1993

[54] MULTI-COMPONENT CUTTING ELEMENT USING CONSOLIDATED ROD-LIKE POLYCRYSTALLINE DIAMOND

[75] Inventors: Alexander K. Meskin; Louis K. Bigelow, both of Salt Lake City, Utah

[73] Assignee: Eastman Christensen Company, Salt Lake City, Utah

[21] Appl. No.: 393,862

[22] Filed: Aug. 11, 1992

Related U.S. Application Data

[63] Continuation of Ser. No. 184,494, Jan. 26, 1988, abandoned, which is a continuation of Ser. No. 797,858, Nov. 14, 1985, abandoned, which is a continuation of Ser. No. 593,124, Mar. 26, 1984, abandoned.

[51] Int. Cl.[5] ..... E21B 10/58; B23B 27/20

[52] U.S. Cl. ..... 408/145; 51/206 R; 76/DIG. 12; 175/374; 175/434

[58] Field of Search ..... 408/145; 125/11 R, 39; 51/204, 206 R; 76/DIG. 18, DIG. 12, 101 R, 108 A; 175/329, 330

[56] References Cited

U.S. PATENT DOCUMENTS

| | | | |
|---|---|---|---|
| 3,440,773 | 4/1969 | Hawkes | 51/206 R |
| 3,885,637 | 5/1975 | Veprintsev et al. | 175/329 |
| 4,041,650 | 8/1977 | Sawluk | 51/206 R |
| 4,081,203 | 3/1978 | Fuller | 175/325 |
| 4,451,093 | 5/1984 | Perez | 125/40 |
| 4,452,325 | 6/1984 | Radd et al. | 76/108 R |
| 4,529,047 | 7/1985 | Meskin et al. | 175/329 |
| 4,537,097 | 8/1985 | Illerhaus et al. | 76/DIG. 12 |
| 4,726,718 | 2/1988 | Meskin et al. | 408/175 |

FOREIGN PATENT DOCUMENTS

| | | | |
|---|---|---|---|
| 233479 | 4/1969 | U.S.S.R. | 76/DIG. 12 |
| 632823 | 11/1978 | U.S.S.R. | 175/329 |
| 2044146 | 10/1980 | United Kingdom . | |
| 2107298 | 4/1983 | United Kingdom | 408/145 |
| 2115460 | 9/1983 | United Kingdom | 175/329 |

*Primary Examiner*—Hien H. Phan

*Attorney, Agent, or Firm*—Trask, Britt & Rossa

[57] ABSTRACT

An enlarged diamond table for use as a cutter in rotating drill bits is provided by disposing a plurality of thermally stable or leached polycrystalline diamond (PCD) rod-like elements within a matrix body. In one embodiment the matrix body is impregnated with diamond grit and completely fills the interstitial spaces between the plurality of PCD elements. Generally, the PCD elements have their longitudinal axes arranged in a mutually parallel configuration. The bundle of rod-like diamond elements are in one embodiment in a compact touching array and in another embodiment in a spaced-apart array. In the illustrated embodiment, a bundle of rod-like diamond elements are disposed so that their end surfaces are exposed on the cutting face of the cutting slug. The slug is then in turn mounted on a stud or directly infiltrated into a matrix body bit.

10 Claims, 2 Drawing Sheets

FIG. 10
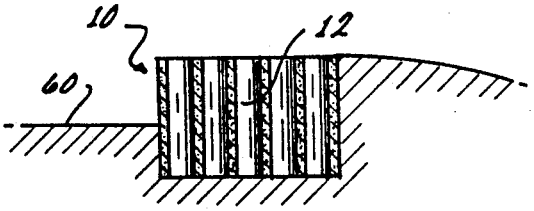
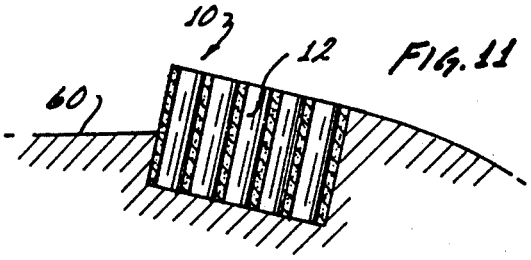
FIG. 11
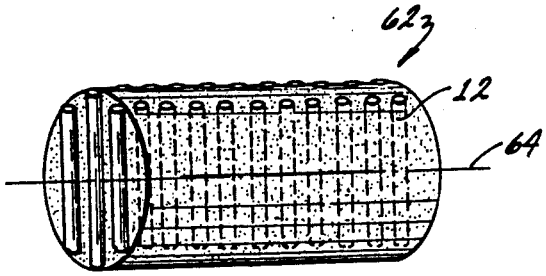
FIG. 12
FIG. 13
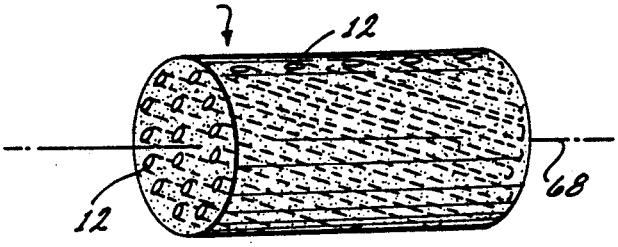
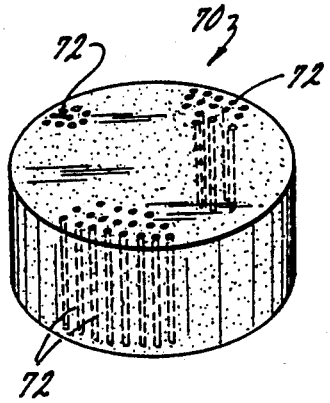
FIG. 14
FIG. 15
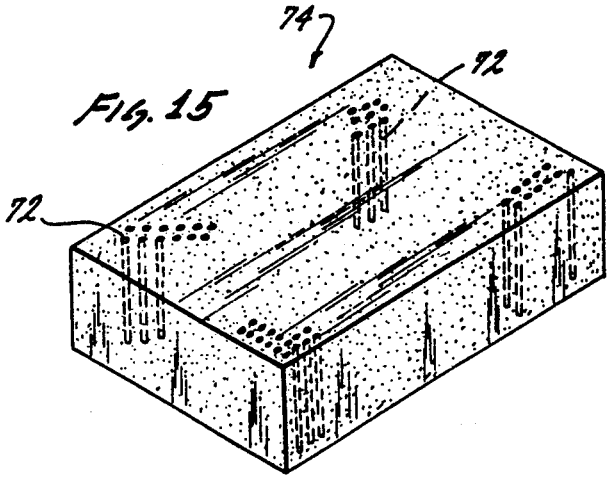

MULTI-COMPONENT CUTTING ELEMENT USING CONSOLIDATED ROD-LIKE POLYCRYSTALLINE DIAMOND

This is a continuation of application Ser. No. 184,494 filed Jan. 26, 1988, now adandoned, which was a continuation of application Ser. No. 797,858 filed Nov. 14, 1985, now abandoned, which was a continuation of application Ser. No. 593,124 filed Mar. 26, 1984, now abandoned.

BACKGROUND OF THE INVENTION

1. Field of the Invention

The present invention relates to the field of earth boring tools and in particular relates to diamond cutters used on rotating bits.

2. Description of the Prior Art

Rotating diamond drill bits were initially manufactured with natural diamonds of industrial quality. The diamonds were square, round or of irregular shape and fully embedded in a metallic bit body, which was generally fabricated by powder metallurgical techniques. Typically, the natural diamonds were of a small size ranging from various grades of grit to larger sizes where natural diamonds of 5 or 6 stones per carat were fully embedded in the metal matrix. Because of the small size or the natural diamonds, it was necessary to fully embed the diamonds within the matrix in order to retain them on the bit face under the tremendous pressures and forces to which a dill bit is subjected during rock drilling.

Later, the commercial production of synthetically produced diamond grit and polycrystalline stones became a reality. For example, synthetic diamond was sintered into larger disk shapes and were formed as metal compacts, typically forming an amalgam of polycrystalline sintered diamond and cobalt carbide. Such diamond tables are commercially manufactured by General Electric Company under the trademark STRATAPAX. The diamond tables are bonded, usually within a diamond press to a cobalt carbide slug and sold as an integral slug cutter. The slug cutters are then attached by the drill bit manufacturers to a tungsten carbide slug which is fixed within a drill bit body according to the design of the bit manufacturer.

However, such prior art polycrystalline diamond (PCD) compact cutting slugs are characterised by a low temperature stability. Therefore, their direct incorporation into an infiltrated matrix bit body is not practical or possible at this time.

In an attempt to manufacture diamond cutting elements or improved hardness, abrasion resistance and temperature stability prior art diamond synthesizers have developed a polycrystalline sintered diamond element from which the metallic interstitial components, typically cobalt, carbide and the like, have been leached or otherwise removed. Such leached polycrystalline synthetic diamond is manufactured by the General Electric Company under the trademark GEOSET, for example 2102 GEOSETS, which are formed in the shape of an equilateral prismatic triangle 4 mm on a side and 2.6 mm deep (3 per carat), and as a 2103 GEOSET shaped in the form of an equilateral triangular prismatic element 6 mm on a side and 3.7 mm deep (1 per carat). However, due to present fabrication techniques, in order to leach the synthetic sintered PCD and achieve the improved temperature stability, it is necessary that these diamond elements be limited in size. Therefore, whereas the diamond compact slug cutters, STRATAPAX, may be formed in the shape of circular disks of ⅜" (9.5 mm) to ½" (12.7 mm) in diameter, the leached triangular prismatic diamonds, GEOSETS, have maximum dimensions of 4 mm to 6 mm. It is well established that at least in soft formations the cutting rate of a diamond rotating bit is substantially improved by the size of the exposed diamond element available for useful cutting. Therefore, according to the prior art, the increased temperature stability of leached diamond products has been achieved only at the sacrifice of the size of the diamond elements and therefore the amount of diamond available in a bit design for useful cutting action.

What is needed then is a PCD cutter which is characterised by the temperature stability and characteristics or leached diamond products, and yet has the size available for useful cutting action which is characterised by the larger unleached diamond products.

BRIEF SUMMARY OF THE INVENTION

The invention is a diamond cutting element for use in a drill bit comprising a plurality of thermally stable PCD cutting elements wherein each element is characterised by having a longitudinal axis. A cutting slug is formed of matrix material. The plurality of PCD elements are disposed in the matrix material so that their longitudinal axes are generally mutually parallel. Furthermore, the matrix material forming the cutting slug may incorporate diamond grit dispersed at least through a portion of the cutting slug near the exposed end of the slug or its cutting face. By reason of this combination of elements, an enlarged diamond cutting slug can be provided for mounting within the drill bit.

More particularly, the invention is a diamond cutter for use in a drill bit. The diamond cutter comprises a plurality or leached PCD elements each of which are characterised by having a longitudinal axis. The PCD elements are arranged and configured in the cutter so that their longitudinal axes are mutually parallel. Diamond bearing matrix material is disposed between the plurality of PCD elements to form an aggregate cutting slug of a predetermined gross shape. By reason of this combination o elements, an enlarged diamond cutter having a geometric size or unleached diamond product is provided and is substantially characterised by having the physical or material properties or the plurality of leached PCD elements.

The invention includes a diamond cutter element for use in a drill bit comprising a plurality of thermally stable polycrystalline diamond cutting elements wherein each cutting element is characterized by a longitudinal axis. The diamond cutter element also includes a matrix material forming a cutting slug. The plurality of PCD elements are disposed in the matrix material so that the longitudinal axes of each of the elements are generally mutually parallel. The cutting slug is disposed in the drill bit to present the longitudinal axes of the plurality of PCD cutting elements in a predetermined direction. The cutting slug is characterized by a cutting direction and the cutting direction is defined as the instantaneous direction of the linear displacement of the cutting slug as determined by the drill bit when the drill bit is operative, typically rotating. In general, the predetermined direction may be parallel, perpendicular, or inclined with respect to the cutting direction and each PCD cutting element is characterized by having a needle-like shape.

The invention is illustrated in the following Figures wherein like elements are referenced by like numerals.

BRIEF DESCRIPTION OF THE DRAWINGS

FIG. 10 is a cross-sectional side view of an infiltrated cutting tooth using the cutter shown in FIG. 1, wherein the cutter is generally perpendicularly oriented with respect to the bit face.

FIG. 11 is a cross-sectional side view of an infiltrated cutting tooth using the cutter shown in FIG. 1, wherein the cutter is generally oriented at an angle with respect to the bit face.

FIG. 12 is a perspective view of a cutter wherein a plurality of PCD rods are transversely oriented with respect to a longitudinal axis of the cutter.

FIG. 13 is a perspective view of a cutter wherein the PDC rods are oriented at an angle with respect to the longitudinal axes of the cylindrical cutter.

FIG. 14 is a perspective view of a cylindrical cutter wherein the PCD elements are oriented diamond needles.

FIG. 15 is a perspective view of a generally rectangular cutter wherein the PCD elements are oriented diamonds needles.

The various embodiments of the invention can be better understood by considering the above Figures in light of the following detailed description.

DETAILED DESCRIPTION OF THE PREFERRED EMBODIMENT

The invention is an improved PCD cutter made of composite of thermally stable or leached rod-like diamond elements wherein the elements are combined to form an enlarged cutter body, and are bound together by a metallic matrix to form an enlarged, exposed diamond cutting surface. The multiple edges of the PCD elements tend to increase the total effective cutting perimeter.

Figure 1:
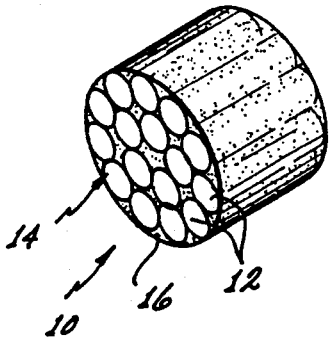
FIG. 1 is a perspective view of a diamond cutter utilizing cylindrical rod-like PCD pieces.

Consider first the embodiment of FIG. 1. A cutter body, generally denoted by reference numeral 10, is comprised or a plurality of diamond cutting elements 12. Diamond cutting elements 12, in the preferred embodiment are each in the form of right circular cylinder having a diameter of approximately 0.25" to 0.75" and a height of approximately 0.078 inch (1.98 mm) to 0.394 inch (10.0 mm). Although such cylindrical rod-like diamond elements are generally in the form of a right circular cylinder one end of the cylinder is formed as a flat perpendicular surface while the opposing end is formed an axially symmetric dome or conical shape of approximately 0.039–0.118 inch (1–3 mm) in height depending on the size of the cylinder and manufacturing variations. For example, dome topped PCD cylinders of the following diameters and lengths respectively are presently commercially available: 2 mm diameter by 3 mmm long; 4 mm by 6 mm; 6 mm by 6 mm; 6 mm by 8 mm; and 8 mm by 10 mm. The shape and proportions of each vary depending on gross geometries and minor process variations.

In the illustrated embodiment of FIG. 1, cutter 10 is shown in perspective view with a cutting face 14 facing the viewer. The PCD elements 12 as described above may be oriented within cutting slug 10 with the axial ends of cylinders 12 generally coplanar with face 14. In other words, each of the plurality of rod-like cylindrical diamond elements 12 are disposed with their axis of symmetry generally parallel to the axis of symmetry of cylindrical cutting slug 10. Further, each of the diamond elements 12 is of approximately identical shape and size so that when bundled to form cutting slug 10, one axial end of each cylindrical element 12 can be aligned with the corresponding ends of each of the other cylindrical elements in the bundle to form a generally flat face 14. Either the flat or domed end or both of cylindrical elements 12 may be oriented on face 14.

Therefore, as shown in the illustrated embodiment of FIG. 1, face 14 of cutting slug 10 forms a generally circular surface. Inasmuch as cylindrical diamond elements 12 are also circular in cross section, the interstitial space between cylindrical diamond elements 12 throughout cutting slug 10 is filled with a metallic matrix 16. The composition of matrix 16 may be chosen from powder mixtures well known in the art as presently used for the fabrication of powder metallurgical infiltration bits. Generally, such metallic matrices 16 are tungsten carbide sintered mixtures containing selected amounts of various other elements and compounds as are well known in the art to achieve the desired body characteristics.

According to the present invention, matrix 16 within cutting slug 10 is impregnated with natural or synthetic diamond grit, thereby substantially improving the abrasive resistant qualities of matrix 16. The grit is disposed within cutting slug 10 at least within the proximity of the cutting face, and preferably uniformly throughout its volume. Again, the mesh or size of diamond grit included within matrix 16 between rod-like diamond elements 12 can be selected according to well known principles to obtain the desired abrasive results. Generally, the diameter of such grit varies between 0.010 inch (0.00254 mm) to 0.05 inch (1.27 mm). A grit concentration of 50 % to 100% by volume is preferred.

Consider now slug 10 of the embodiment of FIG. 1. Slug 10 can be fabricated either by conventional infiltration or hot pressing techniques. Consider, for example, the fabrication according to hot pressing techniques. A plurality of cylindrical diamond rods 12 are arranged in a hot press mold either in the compact touching configuration as shown in FIG. 1 or in a spaced-apart configuration similar to that described in connection with the below described embodiments of the invention. Selected matrix powder 16 is similarly loaded into the mold between the interstitial areas between cylinders 12 as well as above or below the bundle cylinders by amount taking into consideration the greater compressibility of the material of matrix 16 as compared with that of synthetic diamond of rods 12. Typically, such mold parts are made of graphite and are then placed within a conventional hot press. The mold and its contents are then heated, usually by a conventional induction heater, and subject to pressure. The pressures and temperatures used to form cutting slug 10 are well outside of the diamond synthesis phase regions and result in a compact sintered matrix mass in which rods 12 are securely embedded as depicted in FIG. 1. For example, a pressure of approximately 200 psi and a temparture of 1900° F. exerted and held on a cylindrical mold holding a cylindrical bundle of diamond elements 12 for a period of 3 minutes produces slug cutter 10 as depicted in FIG. 1. It is understood, of course, that many other temperatures, pressures and holding times could be equivalently employed without departing from the spirit and scope of the invention.

Figure 2:
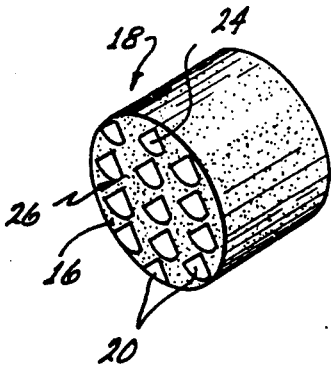
FIG. 2 is a perspective view of a second embodiment of a cutter wherein a plurality of quarter-split cylinders are employed.

Turn now to the second embodiment of FIG. 2 wherein a perspective view of a right circular cylindrical cutting slug 18 is depicted. In contrast to the first embodiment of FIG. 1, the embodiment of FIG. 2 incorporates a plurality of split cylindrical diamond elements 20 embedded within an interstitial diamond bearing metallic matrix 16. In the illustrated embodiment, rod-like PCD elements 20 are comprised of quarter-split cylindrical elements. In other words, the right circular cylindrical elements 12 described in connection with FIG. 1 are sectioned into quarters to form quarter-split cylinders. Such section can be accomplished by laser cutting, electrodischarge machining or other equivalent means. Split cylindrical elements 20 may then be arranged in a spaced-apart pattern as depicted in FIG. 2, each with its apical point 24 oriented in the same direction as shown, oriented in radial directions, alternating in reversed directions or other convenient patterns as may be chosen. Again, the interstitial matrix material 16 incorporates a diamond grit to prevent the erosion of matrix 16 from between elements 20 while cutting slug 18 is subjective to the abrasive wear of rock and hydraulic fluid in a drill bit.

Again, cutting slug 18 of FIG. 2 may be fabricated by conventional hot pressing or infiltration techniques as described. Consider now fabrication by an infiltration technique. Elements 20 are disposed in a generally parallel, spaced apart bundle, with the longitidinal axis of each rod-like cutter 20 generally parallel and spaced apart from the longitudinal axis of the adjacent rod-like elements 20. The axial ends of elements 20 are similarly aligned to provide a generally flat cutting face 26. Rods 20 are placed within a predetermined location within a machined carbon mold, typically by gluing in the same manner as natural or synthetic single piece diamonds are placed within infiltration molds. Thereafter, powdered matrix material is filled within the mold and tapped or vibrated, thereby causing it to settle in place within the mold. Diamond elements 20 will then be surrounded by matrix powder. Thereafter the fill mold is furnaced, causing the matrix material to melt and infiltrate downwardly and throughout the mold cavity resulting in the embedded structure as shown in FIG. 2, and as better shown and described in connection with FIG. 9. For the sake of clarity, the depiction of FIG. 2 shows cutter 18 apart from any bit body which may be integrally formed therewith.

Alternatively, cutting slug 18 may be separately fabricated by an infiltration technique apart from a bit mold. A carbon mold defining the shape and size of cutting slug 18 is provided and a plurality of split cylindrical rod elements 20 disposed and fixed within the carbon mold as before by gluing. Thereafter, the interstitial spaces between elements 20 is filled within a selected diamond impregnated matrix material. The carbon mold for cutting slug 18 is thereafter furnaced to allow the matrix material to become sintered and infiltrate between elements 20 The body is cooled and the finished slug removed from the mold. Thereafter, the infiltrated slug can be handled as a single element and placed as described in greater detail in connection with FIGS. 8 and 9 within a bit body.

Figure 3:
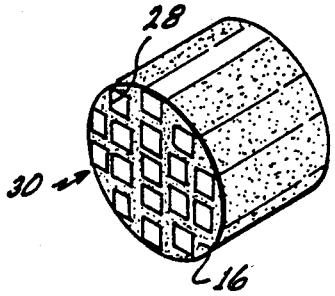
FIG. 3 is a perspective view of a third embodiment of a cutter wherein a plurality of rectangular rod-like diamond elements are employed.

Turn now to FIG. 3 wherein the third embodiment of the invention is illustrated. Whereas the first and second embodiments of FIGS. 1 and 2 respectively showed a plurality of right circular cylindrical or split cylindrical rod elements, the third embodiment of FIG. 3 illustrates the embodiment wherein a plurality of rectangular or square rod-like elements 28 are incorporated within a cutting slug 30. Once again, PCD elements 28 may be placed within cutting slug 30 in a compacted arrangement or in a spaced apart arrangement where in the interstitial metal matrix in either case forms a diamond bearing body. As before, cutting slug 30 is shown as a right circular cylinder and may be formed by conventional hot pressing or infiltration techniques as described above.

Figure 4:
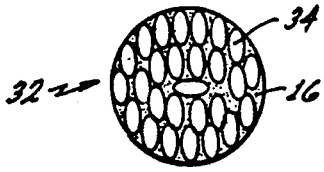
FIG. 4 is an end view of a fourth embodiment of a cutter wherein a plurality of elliptically shaped diamond rods are employed.

FIG. 4 represents yet a fourth embodiment of the invention wherein a right circular cylindrical cutting slug 32 employs a plurality of elliptically shaped rod-like elements 34. In other words, the cross section of elements 34 are generally noncircular or elliptical and are aligned within cutting slug 32 so that their longitudinal axes are generally parallel. Elliptical elements 34 may be arranged within cutting slug 32 in a spaced apart relationship or in a more compacted form wherein each element touches or is immediately proximate to adjacent elements. Again, the interstitial material between elements 34 is comprised of a diamond bearing metallic matrix, and the aggregate body comprising cutting slug 32 is fabricated by hot pressing or infiltration. PCD elements in the invention in a compact array may actually touch each other or may be separated by a thin layer of matrix material which tends to bond the adjacent elements together. For the purposes of this specification, either situation or its equivalent shall be defined as an "immediately proximate" configuration.

Figure 5:
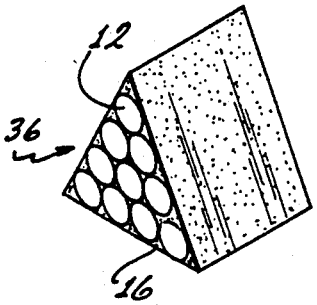
FIG. 5 is perspective view of a fifth embodiment in the form of a triangular prismatic cutter utilizing a plurality of circular diamond rods of the type generally shown in FIG. 1.

A fifth embodiment is illustrated in FIG. 5. Cutting slug 36 of FIG. 5 employs the same right circular cylindrical cutting elements 12 of the embodiment of FIG. 1 but aggregates elements 12 in a bundle or spaced-apart relationship so that the gross overall outline of cutting slug 36 is generally triangular and prismatic. Interstitial areas between elements 12 of cutting slug 36 are again filled with a diamond bearing matrix 16 by hot pressing or infiltration.

Figure 7:
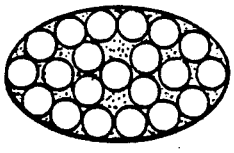
FIG. 7 is an end view of a seventh embodiment in the form of an elliptically shaped prismatic cutter wherein a plurality of cylindrical diamond pieces are employed.
Figure 6:
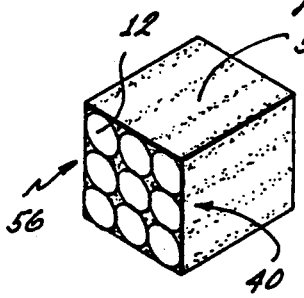
FIG. 6 is a perspective view of a sixth embodiment wherein a prismatic, rectangular cutting element is provided which utilizes a plurality of circular diamond rod pieces.

A variation of overall slug cutter shapes are also shown in the sixth and seventh embodiments of FIGS. 6 and 7 respectively. In the case of FIG. 6, right circular cylindrical elements 12 are shown in perspective view as bundled within a generally rectangular or square cutting slug 40. Rod-like elements 20 are combined either in a compacted and touching bundle or in a spaced-apart relationship wherein the interstitial spaces are again filled with diamond bearing matrix. In the embodiment of FIG. 7, an end view is illustrated showing right circular cylindrical rod-like elements 12 once again aggregated within an elliptically shaped cutting slug 42 bound together in diamond bearing matrix material 16.

Clearly, the various embodiments shown and described in connection with FIGS. 1–7 are set forth purely for the purposes of example and should not be taken as limiting the spirit or scope of the invention. The overall geometric shape formed by the cutting slugs in each case may be chosen according to the optimal design and utility of the bit and combined with any one of a plurality of shapes of rod-like PCD elements arranged as compacted or spaced-apart bundles as shown. The combinations explicitly illustrated are the preferred combinations but by no means exhaust the logical combinations which could be produced between overall gross outline and constituent diamond rod-like elements which can be used according to the invention to form an enlarged diamond cutter. In addition to variations in shapes and sizes as just described, the number of cutting elements included with any chosen slug can also be varied according to the desired result.

Figure 8:
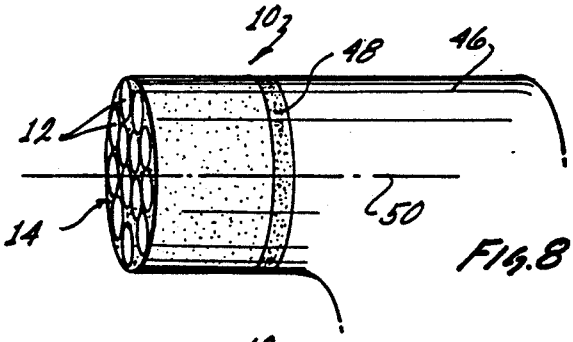
FIG. 8 is a perspective view of a stud cutter employing the cutter shown in FIG. 1.

Turn now to FIG. 8 wherein a cutting slug of the invention is shown as mounted on a stud for insertion within a bit body. In the illustrated embodiment of FIG. 8 the first embodiment of cutting slug 10 is utilized. Cutting slug 10, with cutting face 14 outwardly disposed, is raised onto a tungsten carbide stud 46. Such studs 46 are well known to the art and many designs have been developed for use in connection with diamond contact tables. Thus, as depicted in FIG. 8, cutting slug 10 is bonded to tungsten carbide stud 46 by a brazed layer 48 shown in exaggerated thickness. The longitudinal axes of each rod-like cutting element 12 within cutting slug 10 is arranged within cutting slug 10 so as to be generally parallel to the longitudinal axis of symmetry 50 of the slug 10. Axis 50 as illustrated in FIG. 8 is approximately normal to cutting face 14. Stud 46 is then press fit, brazed and otherwise inserted by conventional means into a bit body (not shown) so that face 14 is disposed so that axis 50 is oriented in a generally azimuthal or advancing direction as defined by the rotation of the rotating bit.

Figure 9:
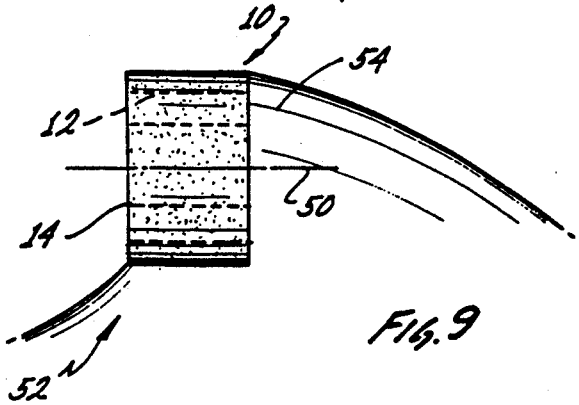
FIG. 9 is a side view of an infiltrated cutting tooth using the cutter shown in FIG. 1, wherein the cutter is generally oriented parallel to the bit face.

Turn now to FIG. 9 wherein the utilization of cutting slug 10 is shown in an alternative embodiment in an infiltration bit. Cutting slug 10 is shown in diagrammatic sectional side view as being directly infiltrated into a matrix body generally denoted by a reference numeral 52. Once again, .cylindrical elements 12 within cutting slug 10 are arranged so that their longitudinal axes are generally parallel to longitudinal axis 50 normal to cutting face 14. Body 52 forms a pocket about cutting slug 10 thereby providing both basal and backing support as diagrammatically depicted by a trailing support portion 54 integral with body 52 of the infiltration bit. The cutting tooth configuration of FIG. 9 is fabricated according to conventional infiltration techniques as described above. In other words, cutting slugs 10 are placed in predetermined positions within the carbon mold with a metallic powder filled behind slugs 10. Thereafter, the filled mold is furnaced, the metallic powder melts and infiltrates to form a solidified mass in which cutting slugs 10 are embedded.

Although in each of the illustrated embodiments rod-like elements 12, 20, 28 and 34 have been shown as having their longitudinal axes each aligned to be generally parallel to a corresponding longitudinal axis of a corresponding cutting slug, it is entirely within the scope of the invention that such diamond elements may be arranged in bundles or in spaced-apart groups so that the axes of each are inclined at predetermined angles with respect to a selected axis of symmetry of the cutting slug. In the extreme, it may be possible for the diamond rod like elements to be arranged and oriented along a direction substantially perpendicular to the normal of the cutting face, such as would be achieved by rotating cutting slug 40 of the embodiment of FIG. 6 so that cutting face of cutting slug 40 was not face 56, as shown in FIG. 6, but an adjacent side, such as face 58.

FIGS. 10–13 illustrate such additional embodiments. FIG. 10, for example, shows the cutter of FIG. 1 wherein cylindrical body 10 is oriented with respect bit face 60 is generally perpendicular orientation. Cylindrical rod-like PCD 16 are again oriented generally parallel to the longitudinal axis of cylindrical cutter 10. However, cutter 10 has been disposed above, on or in bit face 60 of a matrix drill bit accordingly to conventional infiltration fabrication techniques so that PCDs 16 are generally perpendicular to the direction of cutter travel.

FIG. 11 is a cross-sectional view of another embodiment of cutter 10 of FIG. 1, wherein cutter 10 is disposed above, on or in bit face 60 in an angular orientation so that PCD rods 16 are acutely or obliquely aligned with respect to the direction of travel or advance of cutter 10 as the bit is rotated.

FIG. 12 illustrates a cutter, generally denoted by reference remote 62, wherein rod-like PCD elements 12 are transversely disposed within cylindrical cutter 62. Each PCD 12 is oriented within cutter 62 in a direction substantially perpendicular to its longitudinal axis 64. Certain ones of PCD elements 12 may lie on or near longitudinal axis 64, and thus have a length substantially equal to the full diameter of cutter 62. Other ones of PCD elements 12 lie well off longitudinal axis 64, and thus have a length determined by the cord segment across which cylindrical PCD element 12 is disposed within cylindrical cutter 62. The spacing or density of PCD elements 12 within cutter 62 is chosen according to the nature of the rock formation for which cutter 62 is intended. For example, although shown in the illustrated embodiment of FIG. 12 as a loosely spaced array, it is entirely within the scope of the invention that the array of PCD elements 12 may be densely packed in the touching arrangement such as shown in the cutters of FIGS. 1, 5 and 6.

Turn now to FIG. 13, where yet another embodiment of the invention is illustrated in connection with a cylindrical cutter generally denoted by reference numeral 66. Cutter 66 has the same overall gross cylindrical geometry as cutter 62 in FIG. 12 with the exception that rod-like PCD elements 12 are disposed within cutter 66 at a bias or at an angle with respect to longitudinal axis 68. In the embodiment of FIG. 13, each rodlike PCD element 12 is disposed in a predetermined direction at various distances offset from longitudinal axis 68. Thus, biased PCD elements 12 of FIG. 13 form an array of elements offset from longitudinal axis 68, with the length of each element being determined by its position in the array relative to the cylindrical surface of cutter 66. It must be understood with respect to the embodiment of FIG. 13, just as with those shown in FIGS. 10–12, that whereas in the illustrated embodiment elements 12 are shown spaced apart, it is entirely consistent with the invention that a densely packed array could be substituted.

Turning now to FIG. 14, a larger disclike cutter, generally denoted by reference numeral 70 is illustrated, wherein cutter 70 has disposed therein a multiplicity of needle-shaped PCD elements 72. For the sake of clarity of FIG. 14, only a portion of such needle elements are illustrated, and it is contemplated that the entire volume of cutter 70 will be filled with an array of such elements 72. Needle-like elements 72 are much like rod-like PCD elements 12 shown in connection with the embodiments of FIGS. 1–13, with the exception that needle-like elements 72 have a much smaller diameter. Whereas the smallest rod-like PCD element 12 now commercially available measures approximately 2 mm in diameter, needle-like elements 72 have a diameter substantially less than 2 mm. The detailed configuration of the array of needle-like PCD elements 72 within disc cutter 70 can be varied according to the overall cutting and abrasive-wear resistance desired. For example, in the less abrasive formations a space-apart array, such as that suggested in FIG. 14, may be employed. The array may be arranged in concentric circles of needle-like elements 72, wherein elements 72 between each circle may or may not be as azimuthally offset from the adjacent circular row. Additionally, needle-like elements 72 may be compactly disposed within the metal matrix of cutter 70, either according to a regular geometric packing, or in a randomly packed arrangement. Furthermore, although needle-like elements 72 have been shown as each disposed in a direction generally parallel to the longitudinal axis of symmetry of disc-like cutter 70, other orientations of elements 72 within cutter 70, similar to that shown in FIGS. 12 and 13, may also be utilized.

Similarly, turning to FIG. 15, needle-like elements 72 may be disposed in cutters of dramatically different geometric configurations, such as cutter 74 of FIG. 15. Cutter 74 of FIG. 15 is generally a rectangular shaped or block-shaped cutter wherein needle-like elements 72 are disposed, again shown the illustrated view for the sake of clarity only in a partially depicted perspective view. In other words, although FIG. 15 illustrates only certain portions of cutter 74 having elements 72, it is contemplated that the entire volume of cutter 74 is filled with or has elements 72 disposed therein. As in the case of cutter 70 of FIG. 14, cutter 74 of FIG. 15 may employ needle-like PCD elements with varying angles of disposition as described above. For example, rod-like PCD elements 12 of cutter 66 of FIG. 13 may be replaced by a plurality of needle-like elements 72. Cutter 66 is then disposed in or on a bit face with its longitudinal axis 68 generally parallel to the cutting direction. Biased needles 72 replacing rods 12 would then wear or fracture during cutting one needle at a time so that loss of diamond material due to fracturing during cutting is substantially limited.

Therefore, it must be understood that many modifications and alterations may be made by those having ordinary skill in the art without departing from the spirit and scope of the invention. The illustrated embodiment has been shown only for the purposes of example and clarification and should not be taken as limiting the invention which is defined further in the following claims.

We claim:

1. A cutter on a rotary drag bit for earth boring, comprising:

a plurality of thermally stable rod-like polycrystalline diamond elements each having a longitudinal axis, said diamond elements being oriented with their axes in a mutually parallel relationship;

a metal matrix surrounding and securely holding said diamond elements in place, said metal matrix and said diamond elements coextensively terminating at a substantially planar cutting face substantially perpendicular to the orientation of said diamond element axes and predominantly comprised of ends of said diamond elements; and a carrier element supporting said diamond elements in said matrix on said bit in an orientation substantially parallel to the instantaneous direction of linear displacement of said cutter resulting from rotation of said bit.

2. The cutter of claim 1, wherein said diamond elements are disposed in a compact array, wherein each element is in lateral contact with at least one adjacent element.

3. The cutter of claim 2, wherein each diamond element is in lateral contact with at least two adjacent elements.

4. A cutting structure fixedly mounted on a rotary drag bit for earth boring, comprising:

a metal matrix defining a cutting slug;

a plurality of thermally stable rod-like polycrystalline diamond cutting elements having mutually parallel longitudinal axes embedded in said metal matrix and defining therewith a substantially planar cutting surface substantially perpendicular to said axes and formed predominantly by ends of said cutting elements; and a carrier element supporting said cutting slug on said bit, whereby said cutting elements are oriented substantially parallel to the instantaneous linear displacement of said slug resulting from bit rotation.

5. The structure of claim 4, wherein said cutting elements are disposed in a compact array, wherein each element is in lateral contact with at least one adjacent cutting element.

6. The structure of claim 5, wherein each cutting element is in lateral contact with at least two adjacent elements.

7. A cutting structure on a rotary drag bit for earth boring, comprising:

a metal matrix defining a cutting slug;

a plurality of thermally stable rod-like polycrystalline diamond cutting elements each defined by a longitudinal axis and a transverse cross-sectional area of lesser dimensions than said longitudinal axis, said diamond cutting elements being disposed in said cutting slug in mutually longitudinally parallel relationship and terminating at a substantially planar cutting surface defined in minor portion by said metal matrix and in major portion by said cross-sectional area of said diamond cutting elements; and a carrier element supporting said cutting slug on said bit, whereby said diamond cutting elements are oriented at an acute angle to the instantaneous direction of linear displacement of said slug resulting from rotation of said bit.

8. The cutting structure of claim 7, wherein said longitudinal cutting element axes and said planar cutting surface are substantially perpendicular.

9. The structure of claim 7, wherein said cutting elements are disposed in a compact array, wherein each element is in lateral contact with at least one adjacent cutting element.

10. The structure of claim 9, wherein each cutting element is in lateral contact with at least two adjacent elements.

* * * * *

UNITED STATES PATENT AND TRADEMARK OFFICE

CERTIFICATE OF CORRECTION

PATENT NO. : 5,205,684

DATED : 4/27/93

INVENTOR(S) : Meskin, et al.

It is certified that error appears in the above-identified patent and that said Letters Patent is hereby corrected as shown below:

On the title page, [22]: the filing date from "8/11/92" to --8/11/89--;

In Column 1, line 28, change "or" to --of--;

In Column 1, line 31, change "dill" to --drill--;

In Column 1, line 36, change "were" to --was--;

In Column 1, line 53, change "or" to --of--;

In Column 1, line 54, after "stability" insert a comma;

In Column 2, line 18, change "or" to --of--;

In Column 2, line 39, change "or" to --of--;

In Column 2, line 46, change "o" to --of--;

In Column 2, line 47, change "or" to --of--;

In Column 2, line 49, change "or" to --of--;

In Column 3, line 18, after "is" insert --a--;

In Column 3, line 47, change "PDC" to --PCD--;

In Column 3, line 48, change "axes" to --axis--;

In Column 4, line 3, change "or" to --of--;

In Column 4, line 5, after "bodiment" insert a comma;

In Column 4, line 5, after "of" insert --a--;

In Column 4, line 12, after "formed" insert --as--;

In Column 4, line 18, change "mmm" to --mm--;

UNITED STATES PATENT AND TRADEMARK OFFICE

CERTIFICATE OF CORRECTION

PATENT NO. : 5,205,684

DATED : 4/27/93

INVENTOR(S) : Meskin, et al.

It is certified that error appears in the above-identified patent and that said Letters Patent is hereby corrected as shown below:

In Column 4, line 64, after "50%" insert --or more--;

In Column 5, line 9, before "amount" insert --an--;

In Column 5, line 11, after "diamond" delete --of--;

In Column 5, line 20, change "temparture" to --temperature--;

In Column 5, line 39, change "Section" to --Sectioning--;

In Column 6, line 13, change "is" to --are--;

In Column 6, line 31, change "where in" to --wherein--;

In Column 6, line 66, delete "A" and change "variation" to --Variations--;

In Column 7, line 41, change "axes" to --axis--;

In Column 7, line 36, delete the period just before "cylindrical";

In Column 7, line 68, after "furnaced," insert --and--;

In Column 8, line 21, after "respect" insert --to--;

In Column 8, line 22, delete "is" and insert therefor --in a--;

In Column 8, line 23, after "PCD" insert --elements-- and change "16" to --12--;

In Column 8, line 27, change "16" to --12--;

In Column 8, line 32, change "16" to --12--;

UNITED STATES PATENT AND TRADEMARK OFFICE

CERTIFICATE OF CORRECTION

PATENT NO. : 5,205,684

DATED : 4/27/93

INVENTOR(S) : Meskin, et al.

It is certified that error appears in the above-identified patent and that said Letters Patent is hereby corrected as shown below:

In Column 8, line 36, change "remote" to --numeral--;

In Column 9, line 46, after "shown" insert --in--;

Signed and Sealed this

Twenty-fifth Day of January, 1994

*Attest:*

Bruce Lehman

BRUCE LEHMAN

*Attesting Officer*

*Commissioner of Patents and Trademarks*